US006693068B1

(12) United States Patent
Ryan et al.

(10) Patent No.: US 6,693,068 B1
(45) Date of Patent: Feb. 17, 2004

(54) ALKALINE CARPET CLEANING COMPOSITION COMPRISING A PYRROLIDONE-BASED SOLVENT

(75) Inventors: Tracy Ann Ryan, Ramsey, NJ (US); Candice Lida Taylor, Clifton, NJ (US); Frederic Albert Taraschi, Skillman, NJ (US)

(73) Assignee: Reckitt Benckiser Inc., Wayne, NJ (US)

( * ) Notice: Subject to any disclaimer, the term of this patent is extended or adjusted under 35 U.S.C. 154(b) by 0 days.

(21) Appl. No.: 09/806,528

(22) PCT Filed: Oct. 25, 1999

(86) PCT No.: PCT/GB99/03526

§ 371 (c)(1),
(2), (4) Date: May 9, 2001

(87) PCT Pub. No.: WO00/24854

PCT Pub. Date: May 4, 2000

(30) Foreign Application Priority Data

Oct. 28, 1998 (GB) ..... 9823537

(51) Int. Cl.[7] ..... C11D 3/28

(52) U.S. Cl. ..... 510/278; 510/280; 510/405; 510/480; 510/500

(58) Field of Search ..... 510/278, 280, 510/405, 480, 500

(56) References Cited

U.S. PATENT DOCUMENTS

| | | | | | |
|---|---|---|---|---|---|
| 4,124,542 A | | 11/1978 | Devine | ..... | 252/546 |
| 5,395,555 A | * | 3/1995 | Colurciello et al. | ..... | 252/546 |
| 5,928,384 A | * | 7/1999 | Scialla et al. | ..... | 8/137 |
| 6,113,654 A | * | 9/2000 | Peterson | ..... | 8/137 |

FOREIGN PATENT DOCUMENTS

| | | | | | |
|---|---|---|---|---|---|
| EP | 0 648 834 A1 | | 10/1994 | ..... | C11D/1/83 |
| EP | 0 906 950 A1 | | 10/1997 | ..... | C11D/3/00 |
| GB | 2 321 252 A | | 7/1998 | ..... | C11D/3/00 |
| GB | 2321252 | * | 7/1998 | | |
| WO | WO97/00934 | | 1/1997 | ..... | C11D/17/00 |

OTHER PUBLICATIONS

Copy of GB Search Report for GB 9823537.7 dated Jan. 20, 1999.

Copy of PCT Search Report for PCT/GB99/03526 dated Feb. 15, 2000.

* cited by examiner

*Primary Examiner*—Charles Boyer
(74) *Attorney, Agent, or Firm*—Fish & Richardson P.C.

(57) ABSTRACT

Improved aqueous carpet cleaning compositions which are ideally suited for use in machinery designed or used in the mechanical cleaning of carpets. The compositions are alkaline, and include one or more detersive surfactants, preferably one or more nonionic surfactants and one or more anionic surfactants; at least about 2% wt. of aminopolycarboxylic acid salt; an organic solvent constituent, preferably which includes a pyrrolidone based organic solvent constituent and excludes glycol and glycol ether solvents; an anti-resoiling agent; and water in quantum sufficient to provide 100% wt. of the compositions, as well as further optional constituents.

15 Claims, No Drawings

ALKALINE CARPET CLEANING COMPOSITION COMPRISING A PYRROLIDONE-BASED SOLVENT

The present invention relates to cleaning compositions which are useful in the cleaning of carpet fibers, carpets and carpeted surfaces. The present invention is particularly directed to compositions useful in conjunction with machinery designed for the cleaning of such carpet fibers or carpets, as well as for a new process for the cleaning of carpet fibers or carpets.

While carpet cleaning compositions are per se, known to consumers, many of these are directed to be used directly from their container, and to be applied to localized areas of carpets. Some are also known for use in the cleaning of broader areas of carpets or carpet surfaces, and these are typically used for cleaning such areas as rooms, hallways and the like where carpet surfaces are installed. A limited number of formulations are also known which are directed to be used with machines intended to clean carpets. The use of such machines is becoming widespread as consumers appreciate their labor saving benefits and cleaning effectiveness.

In order to be successful for use in such a machine, a carpet cleaning formulation must perform well in the removal of stains, ideally both oleophilic stains, as well as oleophobic stains, and must be compatible with the materials of construction of the machine. However, as the known art will attest, the production of such a successful formulation is not a trivial problem. Further, it is desirable to also include one or more agents in such formulations which provide a barrier, or which resist resoiling of cleaned carpet surfaces. Certain such agents are known to the art, and these include certain classes of fluorocarbon materials such as those available as ZONYL (ex. DuPont Corp.) as well as FLUORAD materials (ex. 3M Corp.), as well as so-called antiresoiling agents based on certain polymers including acrylic polymers. However, the inclusion of one or more of these agents frequently is not possible due to incompatibilities with one or more other constituents which may be present in a formulation. Thus, their compatibility, in a formulation is rarely predicable to the formulator.

Notwithstanding these difficulties and shortcomings in the art, the present inventors have been successful in their production of a carpet cleaning composition which overcomes many of these shortcomings. These compositions are particularly useful in process for cleaning of carpets, especially in conjunction with a machine designed and used for such purposes.

Accordingly, in a first aspect of the invention there is provided an aqueous carpet cleaning composition which comprises, per 100% wt.:

one or more detersive surfactants, especially one or more nonionic surfactants;

at least about 2% wt. of aminopolycarboxylic acid salt;

an organic solvent constituent, preferably which includes a pyrrolidone based organic solvent constituent and excludes glycol and glycol ether solvents;

an anti-resoiling agent; and, water in quantum sufficient to provide 100% wt. of the compositions. The compositions are alkaline, and preferably are at a pH of at least about 8. In particularly preferred embodiments are ideally suited for use in machinery designed or used in the mechanical cleaning of carpets. These compositions optionally include one or more further constituents including fluorosurfactants particularly those which may impart a hydrophobic and/or oleophobic finish to a treated carpet or carpet fiber, fragrances, coloring agents, thickeners, preservatives, further anti-resoiling agents, pH adjusting agents, pH buffers, as well as other conventional additives known to be useful in liquid carpet cleaning compositions.

A further aspect of the invention provides a process for the cleaning of carpet fibers, carpets and carpeted surfaces such as on walls, floors and the like which comprises the step of providing to such a machine the compositions described herein, and thereafter utilizing the machine in the cleaning of said fibers, carpets or carpeted surfaces.

A still further aspect of the invention provides a process for the producing such carpet cleaning compositions as described herein.

The inventive compositions include one or more detersive surfactants such as anionic, cationic, nonionic and amphoteric surfactants, especially one or more nonionic surfactants.

Exemplary useful anionic surfactants include: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefin sulfonates, paraffin sulfonates, alkyl sulfosuccinates, alkyl ether sulfosuccinates, alkylamide sulfosuccinates, alkyl sulfosuccinamates, alkyl sulfoacetates, alkyl phosphates, alkyl ether phosphates, acyl sarcosinates, acyl isethionates, and N-acyl taurates. Generally, the alkyl or acyl radical in these various compounds comprise a carbon chain containing 12 to 20 carbon atoms.

Particularly useful as anionic surfactants are alkyl sulfate anionic surfactants according to the formula

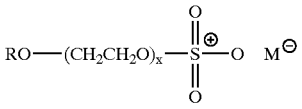

wherein:

R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x has a value of from 0 to about 4.

Most preferred are the non-ethoxylated $C_{12-15}$ primary and secondary alkyl sulfates. Exemplary commercially available alkyl sulfates include those sold as RHODAPON (ex. Rhône-Poulenc Co.) as well as STEPANOL (ex. Stepan Chemical Co.) surfactants.

Further particularly useful alkyl sulfonate anionic surfactants useful in forming the compositions of the present invention are alkyl sulfonates according to the formula

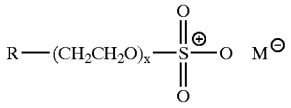

wherein

R is an straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4.

Most preferred are the $C_{12-15}$ primary and secondary alkyl sulfates. Exemplary, commercially available alkane sulfonate surfactants include those sold as HOSTAPUR (ex. H öchst AG) surfactants.

However the most preferred anionic surfactants are those which are characterized as low-foaming materials, but at the same time provide satisfactory detergency. As the present inventive compositions are especially suited for use in a carpet cleaning machinery, anionic surfactants which provide a high degree of foaming may be less desirable from a consumer standpoint. By way of non-limiting example, particularly preferred anionic surfactants which are low foaming include alkylated napthalene sulfates and alkylated napthalene sulfonates, as well as alkali metal and alkaline earth metal salts thereof. One commercially available sodium salt of an alkylated napthalene sold as PETRO 11 liquid (ex. Witco Co.).

Other anionic surfactants not particularly enumerated here may also find use in conjunction with the compounds of the present invention, especially those which are characterized as low-foaming materials.

Exemplary cationic surfactants include quaternary ammonium compounds and salts thereof, examples of which are alkyl dimethyl benzyl ammonium chlorides, alkyl dimethyl benzyl ammonium chlorides, alkyldimethylethylbenzyl ammonium chloride, myristyldimethylbenzyl ammonium chloride, methyldodecylbenzyl ammonium chloride. These materials are commercially available as BARQUAT, BTC or HYAMINE materials (ex. Lonza AG, or Stepan Inc.) However, the use of these materials is not preferred as they provide a low degree of detergency, and are incompatible with most anionic surfactants.

Exemplary useful nonionic surfactants include, inter alia, condensation products of alkylene oxide groups with an organic hydrophobic compound, such as an aliphatic compound or with an alkyl aromatic compound. The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent. Further, the length of the polyethenoxy hydrophobic and hydrophilic elements may be varied to adjust these properties.

One example of such a nonionic surface is the condensation product of one mole of an alkyl phenol having an alkyl group containing from 6 to 12 carbon atoms with from about 5 to 25 moles of an alkylene oxide. Another example of such a nonionic surfactant is the condensation product of one mole of an aliphatic alcohol which may be a primary, secondary or tertiary alcohol having from 6 to 18 carbon atoms with from 1 to about 10 moles of alkylene oxide. Preferred alkylene oxides are ethylene oxides or propylene oxides which may be present singly, or may be both present.

Preferred nonionic surfactants include primary and secondary linear and branched alcohol ethoxylates, such as those based on $C_6$ to $C_{24}$ alcohols which further include an average of from 1 to 18 moles of ethoxylation per moel of alcohol. Particularly preferred nonionic surfactants are $C_{11}$ linear primary alcohol ethoxylates averaging about 9 moles of ethylene oxide per mole of alcohol. These surfactants are available, for example, under the commercial name of NEODOL (ex. Shell Chem. Co.) GENAPOL (ex. Clariant Corp., Charlotte, N.C.), especially those presently marketed in the "GENAPOL 26-L" series. Further examples include secondary $C_{12}$ to $C_{15}$ alcohol ethoxylates, including those which have from about 3 to about 10 moles of ethoxylation, such as in the TERGITOL series (ex. Union Carbide Corp.); linear primary $C_{11}$ to $C_{15}$ alcohol ethoxylates, including those which have from about 3 to about 10 moles of ethoxylation, such as in the NEODOL series of nonionic surfactants (ex. Shell Chemical Co.); and, alkoxylated octyl and nonyl phenols available as IGEPAL surfactants (ex. Rhone-Poulenc, Princeton, N.J.).

One useful class of detersive surfactants include amine oxide compounds, such as octyl dimethyl amine oxide, lauryl dimethyl amine oxide, myristyl dimethyl amine oxide, bis-(2-hydroxyethyl) cocoamine oxide, bis-(2-hydroxyethyl) tallowamine oxide; and bis-(2-hydroxyethyl) stearylamine oxide, cocoamidopropyl dimethyl amine oxide and tallowamidopropyl dimethyl amine oxide, as well as amine oxides in which the alkyl group is a mixture of different amine oxides, such as dimethyl cocoamine oxide, dimethyl (hydrogenated tallow) amine oxide, and myristyl/palmityl dimethyl amine oxide which are frequently provided as technical grade mixtures. These are available in the MACKAMINE series (ex. McIntyre Group) or in the AMMONYX series (ex. Stepan Co.)

A further class of detersive surfactants include compounds based on alkoxy block copolymers, and in particular, compounds based on ethoxy/propoxy block copolymers. Polymeric alkylene oxide block copolymers include nonionic surfactants in which the major portion of the molecule is made up of block polymeric $C_2$–$C_4$ alkylene oxides. Such nonionic surfactants, while preferably built up from an alkylene oxide chain starting group, can have as a starting nucleus almost any active hydrogen containing group including, without limitation, amides, phenols, thiols and secondary alcohols. These include materials presently available under the tradename PLURONIC (ex. BASF). Further detersive surfactants which may be used include carboxylates, particularly one or more alkylpolyoxycarboxylates including alkyletherpolyoxycarboxylates, or alkylarylpolycarboxylates. Exemplary alkylpolyoxycarboxylates and alkylarylpolycarboxylates include alkyl- and alkylaryl-carboxylates. Exemplary carboxylates include SURFINE WLG (ex. Finetex Inc.) and SANDOPAN DTC (ex. Clariant Chem. Co.) and NEODOX (ex. Shell Chemical Co.)

The compositions of the present invention contain one or more further detersive surfactants, and these may be present in any amount which is found to provide a beneficial detersive effect. Generally, the detersive surfactants do not comprise more than 10% wt. (on an actives weight basis) of the inventive compositions. The detersive surfactants are advantageously present in an amount from 0.001–5% wt., preferably are present from 0.1–5% wt., but still more preferably are included in amounts of from 0.1–3.5% wt. Further, it is preferred that both a low foaming anionic surfactant, and a linear primary alcohol ethoxylate be present in the inventive compositions, and that any cationic surfactant be excluded from the compositions. It is further preferred that, on a weight basis, that the nonionic surfactant be present in amounts of at least twice that of any anionic surfactants present.

The compositions of the invention comprise at least about 2% wt. of aminopolycarboxylic acid salt. The aminopolycarboxylic acid salts are compounds in which the amino nitrogen is attached to two or more substituent groups; many such aminopolycarboxylic acids and their salts are known to the art. The preferred salts of these acids are the potassium and the sodium salts, of which two the sodium salt is generally to be preferred. Particularly preferred for are aminopolycarboxylic acid salts particularly the tetrasodium salts. The aminopolycarboxylic acid salts are desirably present in greater amount, i.e., at least about 2.5% wt., and more preferably amounts of at least about 3% wt. of the compositions of which they form a part.

The present inventors have surprisingly found that the inclusion of these relatively high amounts of aminopolycarboxylic acid salts play a significant role in improving the overall cleaning performance of the compositions. This result is particularly surprising, as the aminopolycarboxylic acid salts are not known to provide any significant detergency to compositions in which they are included. This is particularly significant as such an effect allows for the reduction of the overall amounts of detersive surfactants which need be present in a composition, and still provide good cleaning performance.

The compositions of the invention include an organic solvent constituent, which may be a single solvent or which may be a mixture of two or more organic solvents. A wide range of known materials may be used and, without limitation, these include water soluble or miscible alcohols, such as $C_3$–$C_8$ alcohols which may be straight chained or branched, and which are specifically intended to include both primary, secondary and tertiary alcohols. A further class of organic solvents which are particularly preferred are those which are pyrrolidone and pyrrolidone-based solvents, These include for example, N-methylpyrrolidone which is available as M-PYROL (ex. ISP Inc.) as well as others which are known to the art.

The inventors have found that glycol ethers are very desirably omitted from the compositions, as they have been found to destabilize the compositions. Typically, such glycol ethers have been included in many known-art carpet cleaning compositions. Such glycol ethers include many known-art materials presently commercially available under the tradenames CARBITOL or CELLOSOLVE (ex. Union Carbide Corp., Danbury Conn.), DOWANOL (ex. Dow Chem. Co., Midland, Mich.) or ARCOSOLV (ex. Arco Chemical Co.) as well as from other commercial sources.

The organic solvent constituent is desirably present in amounts to about 20% wt., more desirably from about 0.1 to 12.5% wt., still more desirably from about 5 to 10% wt. Most preferably the organic solvent constituent includes one or more pyrrolidone and pyrrolidone-based solvents, and optionally includes further organic solvents, but does not include a glycol or glycol ether solvent. Desirably the one or more organic solvents which make up the organic solvent constituent exhibit a low vapor pressure, particularly less than 0.05 mm Hg at a temperature of 25° C. Such preferred solvents ensure quick evaporation from treated carpets or other fibrous surfaces, and also minimize the residence time of any films formed by the inventive compositions on such treated surfaces, which in turn improves the anti-resoiling characteristics of the inventive compositions.

The inventive compositions include one or more anti-resoiling agents. Such compositions include compounds exhibiting an anti-resoiling effect for example, colloidal silica, aluminum oxides, styrene-maleic anhydride copolymer resins, polyvinylpyrrolidone, polyacrylates, polycarboxylates, modified cellulose polymers, vinyl acetate/maleic anhydride copolymer resins, cationic amines, aliphatic quaternary ammonium salts known to have anti-static properties, imidazoline salts as well as others known to the art. Such compounds which inhibit resoiling may be added in amounts of from 0 to 2% wt., but when present are desirably included in amounts of from 0.001% wt–1% wt.

Particularly preferred anti-resoiling compounds useful in the present inventive compositions are fluorinated acrylic polymers; the inclusion of such fluorinated acrylic polymers and salts in the compositions of the invention improves the resoiling resistance of fibrous substrates treated with said compositions. A specific and preferred fluorinated acrylate copolymer is one which conforms to the formula (C):

$$CF_3(CF_2)_nCH_2OCOC(CH_3)=CH_2 \quad (C)$$

wherein n represents a value of from 6–8.

This fluorinated acrylate copolymer may be generally characterized by a total fluorine content based on polymer solids of approximately 0.6 percent. This fluorinated acrylate copolymer may also contain a zinc complex to act as a crosslinker. The number average (Mn) and weight average (Mw) molecular weights are generally in the range of approximately 9,000 and approximately 10,500 respectively. Such a fluorinated acrylate copolymer may be obtained commercially as a water based dispersion of approximately 76–77 weight % water; 18–19 weight % acrylate copolymer; 1 weight % nonylphenoxypolyethoxyethanol; 1 weight % sodium lauryl sulfate; and 1 weight % zinc oxide complex (with said weight % of the ingredients based on the total weight of the water dispersion), as SYNTRAN 1575 (Interpolymer Corporation, Canton, Mass.). When this SYNTRAN 1575 composition is employed, it may be included in the present inventive compositions in amounts such that the fluorinated acrylate copolymer is present from 0.001–2% wt., desirably in amounts of from 0.001% wt–0.75% wt., and most desirably in amounts of from 0.05% wt.–0.5% wt. with such recited weights being based on the weight of the fluorinated acrylic polymers and/or salts thereof present.

One further anti-resoiling compound particularly useful in the present inventive compositions is a non-halogenated, especially a non-fluorinated, acrylic polymer compound which may be represented by the formula (D):

$$(—CH_2—CH(COOR)—)_n \quad (D)$$

wherein n is a value greater than 50.

Such a non-fluorinated acrylic polymer is presently commercially available and may be obtained as an aqueous dispersion which includes 78–79% wt. water, 18–19% wt. of the non-fluorinated acrylic polymer, 1% wt. of sodium lauryl sulfate, 1% wt. sodium nonylphenoxypolyethoxyethanol sulfate, and 1% wt. zinc oxide complex as SYNTRAN 1580, as well as an aqueous dispersion which includes 74–75% wt. water, 23–24% wt. of the non-fluorinated acrylic polymer, 1% wt. of sodium mono-alkylarylpolyethoxy sulfosuccinate, and 1% wt. sodium lauryl sulfate as SYNTRAN 1588. These materials are considered to be infinitely miscible in water by the manufacturer. The former is provided as an aqueous dispersion having a pH of 8.3 to 9.3, and the latter is provided as an aqueous dispersion having a pH of 7.7 to 8.7. Both of these materials may be obtained from Interpolymer Corporation (Canton, Mass.).

The compositions may include one or more further optional constituents.

As a further optional constituent there may be advantageously included is a preservative constituent. As a significant portion of the formulation comprises water, it is preferable that the preservative be water soluble. Such water soluble preservatives include compositions which include parabens, including methyl parabens and ethyl parabens, glutaraldehyde, formaldehyde, 2-bromo-2-nitropropane-1, 3-diol, 5-chloro-2-methyl-4-isothiazolin-3-one, 2-methyl-4-isothiazoline-3-one, and mixtures thereof. One exemplary composition is a combination of 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. An exemplary commercially available preservative comprising a mixture of 5-chloro-2-methyl-4-isothiazolin-3-one and 2-methyl-4-isothiazolin-3-one marketed under the trademark KATHON CG/ICP (ex. Rohm and Haas) as well as KATHON CG/ICP II, (ex., Rohm and Haas) SUTTOCIDE A (ex. Sutton Laboratories) TEXTAMER 38AD (ex. Calgon Corp.) as well as PROXEL GXL (ex. Zeneca Biocides) described as being 1,2-benzisothiazolin-3-ene (17% wt.) and inert ingredients (83% wt.). The preferred preservative has been observed to exhibit good compatibility with the other constituents in accordance with preferred embodiments of the inventive compositions.

The compositions according to the invention optionally but desirably include an amount of a pH adjusting agent or pH buffer composition. Such compositions include many which are known to the art and which are conventionally used. By way of non-limiting example pH adjusting agents include phosphor containing compounds, monovalent and polyvalent salts such as of silicates, carbonates, and borates, certain acids and bases, tartrates and certain acetates. Further useful pH adjusting agents include acids and bases, particularly organic and inorganic acids which might be useful to lower the alkalinity of the compositions. Exemplary useful inorganic acids include hydrochloric acid, while exemplary useful organic acids include the free acid forms of mono- and polycarboxylic acids, such as citric acid, glycolic acid, and free acid forms of aminopolycarboxylic acids such as ethylenediaminetetraacetic acid. Free acid forms of such aminopolycarboxylic acids, especially those of ethylenediaminetetraacetic acid are particularly preferred as the inclusion of this acid may provide acidity to a formulation, and at the same time may complement the efficacy of the aminopolycarboxylic acid salts which are required to be present in the inventive compositions. Certain particularly preferred embodiments of the invention include both aminopolycarboxylic acid salts and the corresponding aminopolycarboxylic acid in free acid form.

By way of further non-limiting examples, pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, and hydroxides, can also function as buffers. It may also be suitable to use as buffers such materials as aluminosilicates (zeolites), borates, aluminates and certain organic materials such as gluconates, succinates, maleates, and their alkali metal salts. Particularly useful are carbonates, which are included in preferred embodiments of the invention.

The compositions of the invention are alkaline, having a pH of at least about 8, more preferably exhibit a pH of from 8 to 10, and most desirably exhibit a pH of from 8.5 to 9.5. Adjustment of the pH of an inventive composition, where necessary, may be performed by adding an effective amount of one or more of the pH adjusting agents such as acids or bases, or pH buffer compositions described herein.

As further optional constituents there may be included optical brighteners, including those based on stilbene derivatives and distyrylbiphenyl derivatives, especially those based on stilbene derivatives.

The compositions of the invention may optionally include one or more constituents which are intended to modify their visual appearance, such as dyes and/or pigments, as well as compositions which act as opacifiers. These are generally included in only minor amounts, but are desirably omitted.

The compositions of the invention may also optionally include fragrance compositions or other composition for modifying their scent. Such may be any of a number of known materials, including those known to be effective in absorbing odors, those known to be useful in masking odors, as well as those which are known to impart or provide a specific scent. Such fragrance compositions are included in only minor amounts, generally not more than about 1% wt., but preferably even less. Fragrances, whether naturally or synthetically produced may be used in the inventive compositions. Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

As noted previously, the inventive compositions may include one or more further optional constituents which impart a degree of water repellency, oil repellency or both water and oil repellency to carpet fibers and carpet surfaces. These include for example, compositions recited in U.S. Pat. No. 4,145,303 and U.S. Pat. No. 3,901,727 both to Loudas, U.S. Pat. No. 5,370,919 to Fieuws. Such materials useful for imparting water and/or oil repellency to the compositions of the invention include a fluoroaliphatic oligomer or polymer (the term oligomer hereinafter includes polymer unless otherwise indicated) represented by the general formulae (1) and (2):

$$(R_f)_s Z[(R^3)_y Z'B]_t \quad (1)$$

$$[(R_f)_s Z[(R^3)_y Z'B']_t]_w \quad (2)$$

where $R_f$ is a fluoroaliphatic radical,

Z is a linkage through which $R_f$ and $(R^3)_y$ moieties are covalently bonded together, $(R^3)_y$ is a poly(oxyalkylene) moiety, $R^3$ being an oxyalkylene group with 2 to 4 carbon atoms and y is an integer (where the above formulas are those of individual compounds) or a number (where the above formulas are those of mixtures) at least 1, preferably 1 to 125, but can be as high as 180 or higher, B is a hydrogen atom or a monovalent terminal organic radical, B' is B or a valence bond, with the proviso that at least one B' is a valence bond interconnecting a Z-bonded $R^3$ radical to another Z, Z' is a linkage through which B or B', and $R^3$ are covalently bonded together, s is an integer or number of at least 1 and can be as high as 25 or higher, t is an integer or number of at least 1, and can be as high as 60 or higher, and w is an integer or number greater than 1, and can be as high as 30 or higher.

In formulas (1) and (2), where there are a plurality of $R_f$ radicals, these may be either the same or different. This also applies to a plurality of Z, Z', $R^3$, B, B', and, in formula (2), a plurality of s, y and t.

$R_f$ is a stable, inert, nonpolar, preferably saturated monovalent moiety which is both oleophobic and hydrophobic. A fluorinated oligomer preferably comprises from 1 to about 25 $R_f$ groups and preferably comprises about 5 percent to about 30 percent, and more preferably about 8 percent to about 20 percent fluorine by weight based on the total weight of the oligomer, the loci of the fluorine being essentially in the $R_f$ groups. $R_f$ preferably contains at least about 3 carbon atoms, more preferably 3 to about 20 carbon atoms, and most preferably about 6 to about 12 carbon atoms. $R_f$ can contain straight chain, branched chain, or cyclic alkyl groups. $R_f$ is preferably free of polymerizable olefinic unsaturation and can optionally contain caternary heteroatoms such as oxygen, divalent or hexavalent sulfur, or nitrogen. It is preferred that each $R_f$ contain about 40% to about 78% fluorine by weight, more preferably about 50% to about 78% fluorine by weight. The terminal portion of the $R_f$ group contains a fully fluorinated terminal group. This terminal group preferably contains at least 7 fluorine atoms, e.g., $CF_3CF_2CF_2$; $(CF_3)_2CF$; $CF_2SF_5$, or the like.

Perfluorinated aliphatic groups, i.e., those of the formula $C_nF_{2n+1}$, are the most preferred embodiments of $R_f$.

Generally, the oligomers will contain about 5 to 40 weight percent, preferably about 10 to 30 weight percent, of carbon-bonded fluorine.

In the poly(oxyalkylene) radical, $(R^3)_y$, $R^3$ is an oxyalkylene group having 2 to 4 carbon atoms, such as —$OCH_2CH_2$—, —$OCH_2CH_2CH_2$—, —$OCH_2CH_2CH_2CH_2$—, —$OCH(CH_3)CH_2$—, and —$OCH(CH_3)CH(CH_3)$—, the oxyalkylene units in said poly(oxyalkylene) being the same, as in poly(oxypropylene), or present as a mixture, as in a heteric straight or branched chain or randomly distributed oxyethylene, oxypropylene and oxybutylene units or as in a straight or branched chain of blocks of oxyethylene units and/or blocks of oxypropylene units and/or blocks of oxybutylene units. The poly(oxyalkylene) chain can be interrupted by or include one or more catenary linkages. Where said catenary linkages have three or more valences, they provide a means for obtaining a branched chain of blocks of oxyalkylene units. The poly(oxyalkylene) radicals in the oligomers can be the same or different, and they can be pendent. The molecular weight of the poly(oxyalkylene) radical can be about 500 to 2,500 and higher, e.g., 100,000 to 200,000 or higher.

The function of the linkages Z and Z' is to covalently bond the fluoroaliphatic radicals, $R_f$, the poly(oxyalkylene moieties, $(R^3)_y$ and radicals B and B' together in the oligomer. Z and Z' can be a valence bond, for example, where a carbon atom of a fluoroaliphatic radical is bonded or linked directly to a carbon atom of the poly(oxyalkylene) moiety). Z and Z' each can also comprise one or more linking groups such as polyvalent aliphatic and polyvalent aromatic, oxy, thio, carbonyl, sulfone, sulfoxy, phosphoxy, amine, and combinations thereof, such as oxyalkylene, iminoalkylene, iminoarylene, sulfonamido, carbonamido, sulfonamidoalkylene, carbonamidoalkylene, urethane, urea, and ester. The linkages Z and Z' for a specific oligomer will be dictated by the ease of preparation of such an oligomer and the availability of necessary precursors thereof.

Illustrative linking groups Z are alkylene groups, such as ethylene, isobutylene, hexylene, and methylenedicyclohexylene, having 2 to about 20 carbon atoms, aralkylene groups, such as

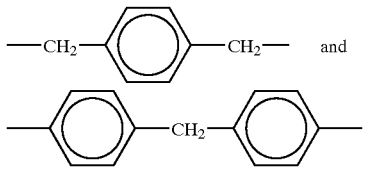

having up to 20 carbon atoms, arylene groups, such as tolylene, —$C_6H_3(CH_3)$—, poly(oxyalkylene) groups, such as —$(C_2H_4O)_yC_2H_4$— where y is 1 to about 5, and various combinations of these groups. Such groups can also include other hetero moieties (besides —O—), including —S— and —N—. However, Z is preferably free of groups with active hydrogen atoms.

From the above description of Z and Z' it is apparent that these linkages can have a wide variety of structures, and in fact where either is a valence bond, it does not even exist as a structure. However large Z or Z' is, the fluorine content (the locus of which is $R_f$) is in the aforementioned limits set forth in the above description, and in general the total Z and Z' content of the oligomer is preferably less than 10 weight percent of the oligomer.

The monovalent terminal organic radical, B, is one which is covalently bonded through Z', to the poly(oxyalkylene) radical.

Though the nature of B can vary, it preferably is such that it complements the poly(oxyalkylene) moiety in maintaining or establishing the desired solubility of the oxyalkylene. The radical B can be a hydrogen atom, an acyl radical such as $C_6H_5C(O)$—, an alkyl radical, preferably lower alkyl, such as methyl, hydroxyethyl, hydroxypropyl, mercaptoethyl and aminoethyl, or an aryl radical, such as phenyl, chlorophenyl, methoxyphenyl, nonylphenyl, hydroxyphenyl, and aminophenyl. Generally, Z'B will be less than 50 weight percent of the $(R^3)_yZ'B$ moiety.

Many of such fluoroaliphatic radical-containing poly(oxyalkylene) compounds are presently commercially available.

In one preferred embodiment of the invention the fluoroaliphatic radical-containing poly(oxyalkylene) compound contains a fluoroalkyl radical having 3 to 20 carbon atoms, wherein perfluoroalkyl radicals are particularly preferred.

In a further preferred embodiment, the fluoroaliphatic radical-containing poly(oxyalkylene) compound can contain 1 to 15, but more preferably 1 to 2, and most preferably an average of about 1.5 ethylene and/or propylene radicals per molecule of the fluoroaliphatic radical-containing poly(oxyalkylene) compound.

Particularly preferred are fluoroaliphatic radical-containing poly(oxyalkylene) compounds which include those which may be represented by the following general structural formula (3):

$$C_aF_{2a+1}N(CH_3)(W)_3(A)_nB^-X^+ \quad (3)$$

in which:

B represents a water soluble group selected from sulfate, sulfonate, carboxylate, phosphate, phosphonate or halogen group;

W represents a lower alkyl group especially a —$CH_2$—, —$CH_2CH_2$— and/or —$CH_2CH_2CH_2$—;

A represents an ethoxy ($OC_2H_4$), propoxy ($OC_3H_6$), and/or butoxy ($OC_4H_8$) or a mixture of two or more such groups;

$X^+$ is a salt forming counterion such as an organic counterion, or an inorganic counterion such as an alkali or alkaline earth metal counterion.

n represents a value of between 1 and 8, preferably is a value of from 1 to 5 inclusive, and most preferably is a value of from about 1 to about 3;

a represents a value of between 1 and 12, preferably is a value of from 5 to 12 inclusive, and most preferably is a value of from about 6 to about 9;

A particularly advantageous fluoroaliphatic radical-containing poly(oxyalkylene) compound which may be used as constituent (a) of the present invention is one which is presently commercially available as FLUORAD FC-138 from the Minnesota Mining and Manufacturing Co. (St. Paul, Minn.) which is described as being a composition consisting essentially of: 37% wt. water, 27% wt. of the fluorochemical salt, 18% wt. of isopropyl alcohol, and 18% wt. of 2-butoxyethanol. While not wishing to be bound to the following representation, it is believed that this advantageous fluoroaliphatic radical-containing poly(oxyalkylene) compound is a fluorochemical salt is extremely similar to or which may be represented by the following general structure formula (4):

$$C_8F_{17}N(CH_3)(CH_2)_3(A)_nOSO_2^-X^+ \quad (4)$$

in which:

n represents a value of between 1 and 3, preferably is a value of from 1 to 2 inclusive, and most preferably is a value of about 1.5;

A represents an ethoxy ($OC_2H_4$) group, propoxy ($OC_3H_6$) group, or a mixture of such groups, but preferably represents ethoxy;

$X^+$ is a salt forming counterion such as an alkali or alkaline earth metal counterion.

The fluoroaliphatic radical-containing poly(oxyalkylene) compound according to constituent (a) is included in the compositions of the invention in amounts of from between about 0.001% wt. to about 3% wt.; more desirably the fluoroaliphatic radical-containing poly(oxyalkylene) compound is present in an amount of from 0.1% wt. and 0.5% wt. based on the total weight of the composition. It is understood that such fluoroaliphatic radical-containing poly (oxyalkylene) compound may be provided with further constituents, such as water, one or more surfactants in commercial preparations. These are described in further detail in U.S. Pat. No. 5,370,919 to Fieuws, as noted above, the contents of which are incorporated by reference.

Further particularly advantageously used materials which may impart water and/or oil repellency to treated substrates include certain fluorosurfactant compositions which may be added in amounts which facilitate the oil repellent, viz., the oleophobic characteristics of substrates treated with the compositions being taught herein. One such exemplary further fluorosurfactant composition which is desirably included in the compositions of the invention is a perfluoropropionate according to the formula:

$$F(CF_2)_n—CH_2CH_2—S—CH_2CH_2—COO^-X^+ \quad (A)$$

where:

n is an integer having a value of 6 to 12; and, $X^+$ is a salt forming counterion, preferably lithium.

Another such exemplary further fluorosurfactant composition includes a perfluoroalkyl phosphate or salt thereof according to the formula (B):

$$CF_3—CF_2(CF_2CF_2)_n—CH_2CH_2—O—P(=O)(O^-)_2 \quad (B)$$

where:

n is an integer having a value of from 6 to 12.

These fluorosurfactant compositions according to formulae (A) and (B) may be used singly, or may be used in a mixture. When used as a mixture, desirably the weight ratio of the perfluoropropionate to the perfluoroalkyl phosphate is in the range of from about 1:1 to 1:2. Such a mixture is presently commercially available as ZONYL 7950. Such fluorosurfactant compositions include those which are described in U.S. Pat. No. 5,439,610 to Ryan, et al., the contents of which are herein incorporated by reference.

Additional exemplary further fluorosurfactant compositions which are desirably included in the compositions of the invention include materials are presently commercially available under the tradename ZONYL from E.I. DuPont de Nemours Co. Exemplary materials include ZONYL FSA which is described as being $F(CF_2CF_2)_{3-8}CH_2CH_2SCH_2CH_2CO_2Li$; ZONYL FSP which is described as being $(F(CF_2CF_2)_{3-8}CH_2CH_2O)P(O)(ONH_4)_2$; ZONYL FSE which is described as being $(F(CF_2CF_2)_{3-8}CH_2CH_2O)_2P(O)(ONH_4)_2$; ZONYL UR which is described as being $(F(CF_2CF_2)_{3-8}CH_2CH_2O)P(O)(OH)_2$ as well as $(F(CF_2CF_2)_{3-8}CH_2CH_2O)_2P(O)(OH)$; ZONYL FSJ which is described as being $(F(CF_2CF_2)_{3-8}CH_2CH_2O)P(O)(ONH_4)_2$ in conjunction with a nonfluorinated surfactant; ZONYL TBS which is described as being $F(CF_2CF_2)_{3-8}CH_2CH_2SO_3H$ as well as $F(CF_2CF_2)_{3-8}CH_2CH_2SO_3NH_4$. Each of these materials may be used jointly, such as in a mixture of two or more fluorosurfactants, or singly.

In the compositions according to the invention, the total weight of such optional constituents should not exceed about 20% by weight of the total weight of the composition, more preferably should not exceed about 10% by weight and most preferably comprises less than about 7% by weight based on the total weight of the composition.

According to a particularly preferred embodiment of the invention, there is provided a concentrated aqueous carpet cleaning composition which comprises (preferably, consists essentially of), per 100% wt.:

one or more detersive surfactants, preferably both a one or more nonionic surfactants and one or more anionic surfactants;

at least about 2% wt. of aminopolycarboxylic acid salt thereof, preferably an ethylenediaminetetraacetic acid salt;

an organic acid;

an organic solvent constituent, preferably which includes a pyrrolidone based organic solvent constituent and which excludes glycol and glycol ether solvents;

an anti-resoiling agent;

optionally but preferably, a pH buffer;

further, optionally, one or more constituents selected from fluorosurfactants particularly those which may impart a hydrophobic and/or oleophobic finish to a treated carpet or carpet fiber, fragrances, coloring agents, thickeners, preservatives, and further anti-resoiling agents; and, water in quantum sufficient to provide 100% wt. of the compositions, wherein such compositions exhibit a pH of from 8 to 10.

It is to be understood that, although the aqueous compositions taught herein have been generally discussed in conjunction with the cleaning of carpets and carpet fibers, it is nonetheless to be understood that they may be utilized in the cleaning of a wide variety of fibers and fibrous substrates including but not limited to those which comprise fibers which are made of naturally occurring or synthetically produced materials, as well as blends or mixtures of such materials. Substrates which can be treated in accordance with this invention are textile fibers or filaments, which may be treated before, during or after their manufacture into fabricated fibrous articles such as fabrics and textiles, rugs, carpets, mats, screens, and the like. Articles produced from such textiles, such as garments and other articles of apparel such as scarves, gloves and the like may also be treated. The textiles and fabrics include those made with or of one or more naturally occurring fibers, such as cotton and wool, regenerated natural fibers including regenerated cellulose, and those made with or of synthetically produced fibers, such as polyamides, polyolefins, polyvinylidene chlorides, acetate, nylons, polyacrylics, rayon, and polyester fibers. Blends of two or more such fibrous materials are also expressly contemplated. Such textiles and fabrics may be woven, non-woven or knitted materials.

The compositions of the invention can be prepared in a conventional manner such as by simply mixing the constituents in order to form the ultimate aqueous cleaning composition. The order of addition is not critical. Advantageously all of the constituents other than water are added to a portion of the total amount of water, and then well mixed. Desirably, the surfactants are first added to a volume of water, followed by any remaining ingredients especially the optional constituents and then any remaining amount of water. In some cases, where certain of the desired constituents (such as certain nonionic surfactants) are not liquids at room temperature, such may need to be liquefied and/or dispersed in an aliquot of the volume of water, usually aided by a dispersing or solubilizing aid. Subsequently any remaining balance of water, if any should be required, is then added. Any pH adjusting agents and/or pH buffering compositions are desirably added last to be in a sufficient amount in order to bring the formed composition within the pH range desired.

The compositions according to the invention may be conveniently applied to a substrate in any of a variety of conventional fashions, such as by spraying, dipping, coating, padding, foam or roller application, or by a combination of one or more of these, or with other methods not noted here but known to the art. Most desirably however, the compositions according to the invention are provided to a machine designed for the treatment of carpeted surfaces, and are advantageously diluted at a ratio of about 1 part composition per 32 parts water; but higher and lower relative dilutions are also contemplated. These machines are known to the consumer, and are ones which, during their normal modes of operation, conventionally automatically dilute the cleaning compositions with a larger volume of water. Typically, this larger volume of water is "hot" water from a domestic water supply and is usually at a temperature of from about 95° F.–140° F. (35° C.–60° C.). Generally, carpets are effectively cleaned by utilizing the present inventive compositions in the normal manner taught by the respective machine's manufacturer. Typically, such a machine is provided with a nozzle wherein the diluted composition is sprayed onto a carpet surface, is optionally but desirably agitated by brushes or other agitator means forming part of the machine, and then vacuumed. In this manner, the diluted sprayed inventive compositions are provided to the carpet, interspersed amongst the carpet fibers by the brushes or other agitator which also acts to loosen entrained soils, and then vacuumed with said loosed soils into the machine.

In contrast to many of the compositions known in the prior art, the aqueous compositions according to the present invention provide surprisingly good cleaning efficacy, and are compatible with a variety of carpet cleaning machines.

The following examples illustrate the superior properties of the formulations of the invention and demonstrate particular preferred embodiments of the inventive compositions. The terms "parts by weight" or "percentage weight" are used interchangeably in the specification are to be understood to represent the weight percent of a specific composition based on the total weight of the composition of which it forms a part, unless indicated otherwise.

TABLE 1

| | Ex.1 | Ex.2 | Ex.3 | Ex.4 | Ex.5 | Ex.6 | Ex.7 | Ex.8 | Ex.9 | Ex.10 |
|---|---|---|---|---|---|---|---|---|---|---|
| ethylenediaminetetraacetic acid, tetrasodium salt | 8.11 | 8.11 | 8.11 | 8.11 | 8.11 | 8.11 | 8.11 | 8.11 | 8.11 | 8.11 |
| ethylenediaminetetraacetic acid | 0.77 | 0.77 | 0.77 | — | — | — | — | — | — | — |
| sodium bicarbonate | 0.06 | 0.06 | 0.06 | — | — | — | — | — | — | — |
| linear primary alcohol ethoxylate | 2.03 | 2.03 | 2.03 | 2.03 | 2.03 | 2.03 | 2.03 | 2.03 | 2.03 | 2.03 |
| anionic surfactant | 1.23 | 1.23 | 1.23 | 1.23 | 1.23 | 1.23 | 1.23 | 1.23 | 1.23 | 1.23 |
| SYNTRAN 1580 | 1.59 | 1.59 | 1.59 | 1.59 | 1.59 | 1.59 | 1.59 | 1.59 | 1.59 | 1.59 |
| M-PYROL | 7.50 | 7.50 | 7.50 | 7.50 | 7.50 | 7.50 | 7.50 | 7.50 | 7.50 | 7.50 |
| fragrance | — | 0.2 | 0.2 | — | — | 0.2 | — | — | — | — |
| FLUORAD FC-138 | — | — | — | 5.36 | 10.72 | — | — | — | — | — |
| BLANKAPHOR SOL | — | — | — | — | — | — | .001 | .002 | — | — |

TABLE 1-continued

| | Ex.1 | Ex.2 | Ex.3 | Ex.4 | Ex.5 | Ex.6 | Ex.7 | Ex.8 | Ex.9 | Ex.10 |
|---|---|---|---|---|---|---|---|---|---|---|
| d.i. water | q.s. | q.s. | q.s. | q.s. | q.s. | q.s. | q.s. | q.s. | q.s. | q.s. |
| pH | 8.76 | 8.50 | 8.51 | 11.31 | 10.77 | 11.41 | 11.40 | 11.52 | 11.57 | 11.85 |

The identity of the specific constituents used to form the compositions described on Table 1 are described on the following Table 2; all constituents described on Table 1 were supplied "as is", with the specific % wt. actives indicated on Table 2.

TABLE 2

| | |
|---|---|
| ethylenediaminetetra-acetic acid, tetrasodium salt | supplied as HAMPENE 100S, 38% wt. actives (ex. Hampshire Chem. Co.) |
| ethylenediaminetetra-acetic acid | supplied as HAMPENE acid, 100% wt. actives (ex. Hampshire Chem. Co.) |
| sodium bicarbonate | supplied in anhydrous form, 100% wt. actives (ex. FMC Corp., or Aldrich Chem. Co.) |
| linear primary alcohol ethoxylate | nonionic surfactant, linear primary C12–C16 alcohol ethoxylate, supplied as GENAPOL 26-L-60 (ex. Clariant Corp.) |
| anionic surfactant | supplied as PETRO 11 Liquid, 50% wt. actives, (ex. WITCO Chem. Co.) |
| N-methylpyrrolidone | supplied as M-PYROL, 100% wt. actives, (ex. ISP Technologies Inc.) |
| fragrance | proprietary compositions of their respective suppliers |
| anti-resoiling agent | supplied as SYNTRAN 1580, 20% wt. actives, (ex. Interpolymer Corp.) |
| fluorosurfactant | supplied as FLUORAD FC-138, 29% wt. actives, (ex. 3M Corp.) |
| optical brightener | stilbene based optical brightener, supplied as BLANKOPHOR SOL, (ex. Bayer AG.) |
| d.i. water | deionized water |

The formulations denoted on Table 1 above were tested for their general cleaning and anti-resoiling behavior on standardized carpet substrates in accordance with industry recognized tests, and were found to be effective in cleaning efficacy.

What is claimed is:

1. An aqueous alkaline carpet cleaning composition which consists essentially of:

one or more detersive surfactants;

at least 2% wt. of an aminopolycarboxylic acid salt;

an organic solvent constituent which includes pyrrolidone or a pyrrolidone-based solvent and excludes glycols and glycol ethers;

an anti-resoiling agent;

optionally, one or more further constituents selected from the group consisting of fluorosurfactants, fragrances, coloring agents, thickeners, preservatives, further anti-resoiling agents, pH adjusting agents, pH buffers, optical brighteners, dyes, pigments, opacifiers, water-repelling ingredients and oil-repelling ingredients; and water in quantum sufficient to attain 100%, wherein said composition exhibits a pH of at least 8.

2. A composition according to claim 1 which includes at least one nonionic surfactant and at least one anionic surfactant.

3. A composition according to claim 1 which includes a nonionic linear primary alcohol ethoxylate surfactant.

4. A composition according to claim 1 which includes an alkylated napthalene sulfate surfactant or an alkylated napthalene sulfonate surfactant.

5. A composition according to claim 1 wherein the aminopolycarboxylic acid salt is the tetrasodium salt of ethylenediaminetetraacetic acid.

6. A composition according to claim 5 which further includes ethylenediaminetetraacetic acid in free acid form.

7. An aqueous alkaline carpet cleaning composition which consists essentially of:

at least one nonionic surfactant and at least one anionic surfactant;

at least 2% wt. of an aminopolycarboxylic acid salt;

an organic solvent constituent which includes a pyrrolidone or a pyrrolidone-based solvent and excludes glycols and glycol ethers;

an anti-resoiling agent;

optionally, a pH buffer;

optionally, one or more further constituents selected from the group consisting of fluorosurfactants which impart a hydrophobic and/or an oleophobic finish to a treated carpet or carpet fiber, fragrances, coloring agents, thickeners, preservatives, and further anti-resoiling agents; and water in quantum sufficient to attain 100% wt., wherein said composition exhibits a pH of at least 8.

8. A composition according to claim 1 which comprises:

up to 10% wt. of one or more detersive surfactants;

up to 20% wt. of the organic solvent constituent;

up to 2% wt. of the anti-resoiling agent; and as an optional constituent, one or more fluorosurfactants which impart a hydrophobic and/or an oleophobic finish to a treated carpet or carpet fiber.

9. The composition according to claim 8 wherein the detersive surfactants include at least one nonionic surfactant and at least one anionic surfactant.

10. The composition according to claim 9 wherein the weight of the nonionic surfactant is at least twice the weight of the anionic surfactant.

11. The composition according to claim 8 wherein the anti-resoiling agent is a non-halogenated acrylic polymer compound of the formula:

$$(—CH_2—CH(COOR)—)_n$$

wherein n is a value greater than 50.

12. The composition according to claim 1 wherein the anti-resoiling agent is a non-halogenated acrylic polymer compound of the formula:

$$(—CH_2—CH(COOR)—)_n$$

wherein n is a value greater than 50.

13. A process for machine cleaning of carpet fibers, carpets and carpeted surfaces which comprises the step of providing to such machine a composition according to claim

1, and thereafter utilizing the machine in the cleaning of said fibers, carpets or carpeted surfaces.

14. A composition according to claim 7 which exhibits a pH of from 8 to 10.

15. A composition according to claim 7 which exhibits a pH of from 10.77 to 11.85.

* * * * *